US005346188A

United States Patent [19]

Rodgers et al.

[11] Patent Number: 5,346,188

[45] Date of Patent: Sep. 13, 1994

[54] HINGED WIRE FORM MEMBERS

[75] Inventors: Kevin T. Rodgers, Stamping Ground, Ky.; James Lewis, Hanover Park, Ill.

[73] Assignee: Hoover Group, Inc., Alpharetta, Ga.

[21] Appl. No.: 31,095

[22] Filed: Mar. 14, 1993

[51] Int. Cl.[5] ..... F16F 3/00; A47C 25/00

[52] U.S. Cl. ..... 267/106; 267/95; 267/103; 267/105; 5/247; 5/255

[58] Field of Search ..... 5/247, 255, 476, 249, 5/240; 267/103, 106, 95, 165

[56] References Cited

U.S. PATENT DOCUMENTS

| | | | |
|---|---|---|---|
| 4,377,279 | 3/1983 | Schulz, Jr. et al. | 5/247 |
| 4,771,995 | 9/1988 | Wells et al. | 5/247 |
| 4,903,949 | 2/1990 | Schulz, Jr. | 5/240 |
| 5,052,064 | 10/1991 | Hagemeister et al. | 5/247 |
| 5,178,372 | 1/1993 | Rodgers et al. | 5/255 |

*Primary Examiner*—Alexander Grosz
*Attorney, Agent, or Firm*—Harness, Dickey & Pierce

[57] ABSTRACT

A foundation assembly is disclosed in which a wire grid is supported above a support frame by a plurality of wire form members extending parallel to one another and arranged in pairs. The wire form members have leg portions extending therefrom and are rotatably mounted to the wire grid to enable a wire subassembly to be shipped with the wire form members rotated to folded positions in which the leg portions lie against the wire grid. After shipping, the wire form members are rotated to extend the leg portions away from the wire grid at an angle less than ninety degrees where the paired wire support members cooperate together forming a rigid structure to prevent collapse of the foundation assembly.

17 Claims, 3 Drawing Sheets

HINGED WIRE FORM MEMBERS

BACKGROUND OF THE INVENTION

The present invention relates to a bedding foundation and in particular to a foundation having hinged wire form members supporting a wire grid above a support frame.

Bedding foundations come in a variety of forms. In a box spring foundation, a rectangular wire grid is mounted to and spaced above a rectangular support frame by a plurality of spring elements. The spring elements between the wire grid and support frame provide for resilient deflection of the wire grid in the vertical direction.

Other foundations are fabricated with a rectangular wire grid mounted to and spaced above a support frame by rigid support members that do not permit significant vertical deflection of the wire grid relative to the support frame. A padding material such as foam rubber is used to cushion the top of the wire grid for comfort. Such an foundation provides a firm support for a mattress. In addition, the total quantity of wire required in the foundation is reduced, thereby reducing the cost of the foundation assembly.

Bedding foundations are often produced in a two step process. A first manufacturer produces the wire components of the foundation, i.e. the wire grid and springs or support members and possibly the lower support frame. These are then shipped to a bedding manufacturer where the padding and upholstery are applied to complete the foundation production. However, the nature of a bedding foundation results in a large volume of space being occupied during shipment from the wire manufacturer to the bedding manufacturer. To reduce the space required for shipping, two approaches have been taken.

One approach has been to produce a subassembly consisting of the wire grid and springs or support members. The springs or support members are configured so that the subassembly is stackable with the springs or support members of one subassembly being nested into those of the subassembly therebelow. Once the subassemblies are received by the bedding manufacturer, the wire subassemblies are then mounted to support frames to complete the foundation structure which is subsequently padded and upholstered. An example of a such a stackable foundation is shown in U.S. Pat. No. 5,052,064, issued to Hagemeister et al. One disadvantage of stacking the wire subassemblies is that the wire grid and springs or support members must be configured to provide openings from above for nesting. This can result in a less than optimum arrangement of the grid wires or spring locations.

The other approach to reducing the shipping height of the foundation is to attach the wire subassembly to the support frame in a manner that enables the foundation to be collapsed to lower the wire grid directly onto the support frame. Once received by the bedding manufacturer, the wire grid is raised above the support frame and additional support members, which were previously unattached to the support frame, are then attached to fix the wire grid in spaced relationship above the support frame to prevent collapse of the wire grid.

An example of a foldable or collapsible foundation is shown in U.S. Pat. No. 4,377,279 issued to Schulz, Jr. The support members in the Schulz, Jr., patent are hingedly secured to the upper wire grid and to the bottom support frame to permit the foundation to be reduced in height by rotating the support members from a vertical position to a near horizontal position, thus lowering the wire grid to the support frame. To complete the assembly, the wire grid is raised, moving the support members to planes substantially normal to the planes of the wire grid and the support frame. To hold the wire grid spaced above the support frame, a plurality of struts inclined between the wire grid and the support frame are then attached to the support frame. At least one of the struts is inclined in the opposite direction from at least one other strut to provide support in both directions of movement provided by the hinged attachments of the support members.

A disadvantage of this approach is the need for two different support members, one for vertical support, and the other, the inclined struts, solely to prevent collapse. Furthermore, by attaching the inclined struts to the frame after shipping, the equipment for making the attachments is needed at two locations, at the wire manufacturer for attaching the hinged support members and at the bedding manufacturer for attaching the inclined struts.

Accordingly, it is an object of the present invention to provide a bedding foundation which can be shipped in compact stacks and which overcomes the disadvantages found in the prior art.

The foundation of the present invention includes a wire subassembly of the grid and support members but, instead of nestably stacking the subassemblies, the support members are hingedly attached to produce a compact stack. The subassemblies are shipped separate from the support frames. The support members used to mount the grid above the support frame are hinged to the grid wires for rotation between folded and standing positions and include leg portions. In the folded position, the leg portions are positioned against the grid and, when the support members are in the standing position, the leg portions extend downward from the grid.

In the standing position of the support members, the leg portions are not normal to the grid as in the Schulz, Jr. patent but instead are inclined relative to the wire grid at an angle less than ninety degrees. Half of the leg portions are inclined in one direction with the other half inclined in the opposite direction. When the assembly is completed, the oppositely directed leg portions cooperate with one another to hold the wire grid rigidly positioned above the support frame. Thus, the additional struts shown in the Schulz, Jr., patent are no longer needed. In addition, the need for equipment to attach the support members to the frame is only needed at one location, the bedding manufacturer's. Because the wire subassemblies are not stacked as in Hagemeister et al., the grid wires can be located where needed for the desired support, not for nestably stacking the wire subassemblies.

It is a feature of the support members that plural identical support members are attached to the grid in a common orientation and which act together to provide rigid support of the grid. No separate members are needed to prevent collapse of the foundation due to the hinged support member attachment. Only one configuration of support members is used.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
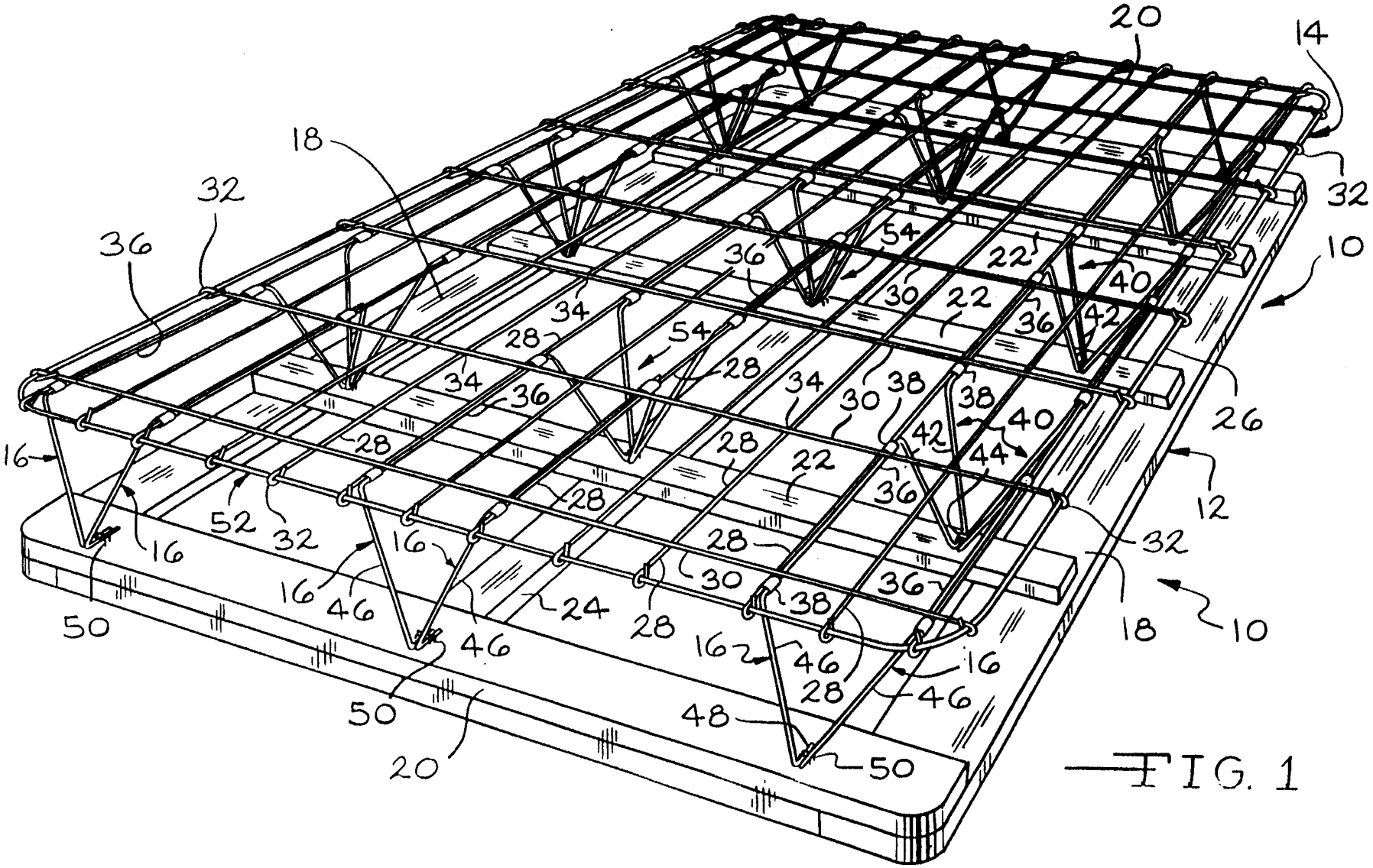
FIG. 1 is a perspective view of the bedding foundation of the present invention.
Figures 2, 3:
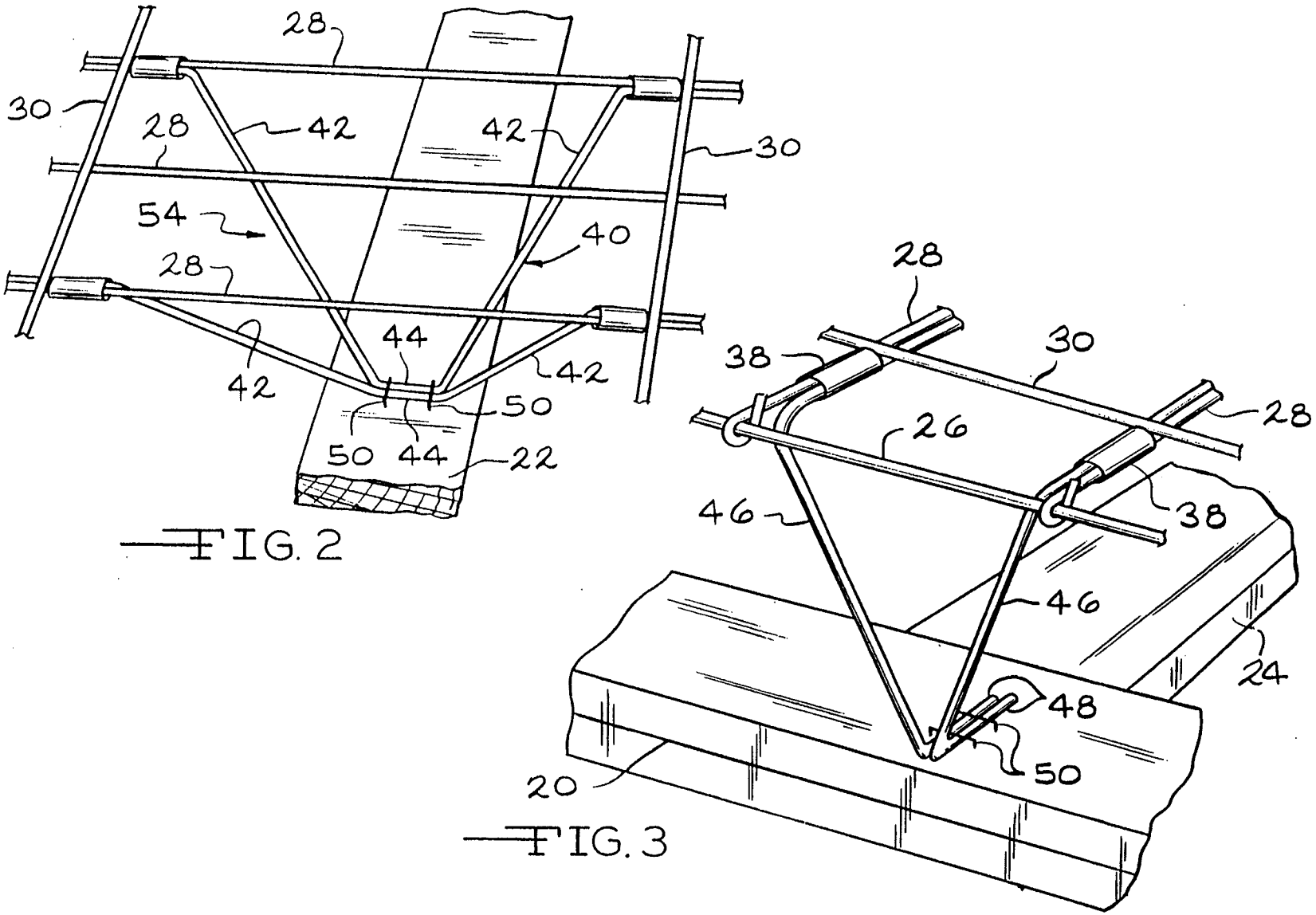
FIG. 2 is an enlarged perspective view of an intermediate leg portion of the foundation of FIG. 1.
FIG. 3 is a perspective view of an end leg portion of the foundation of the present invention.

The foundation of the present invention is shown in FIG. 1 and designated generally as 10. The foundation 10 consists of a rectangular support frame 12, a wire grid 14 and a plurality of wire form members 16 between the grid and support frame to position the grid at a spaced distance above the support frame.

The support frame 12 is constructed having a pair of side rails 18, a pair of end rails 20, spaced cross rails 22 substantially parallel to the end rails 20 and one or more spaced longitudinal rails 24 substantially parallel to the side rails 18. Both the end rails 20 and cross rails 22 are positioned to overlap the side rails 18 such that the end rails and cross rails lie generally within the same plane.

The wire grid 14 or mattress support deck is disposed a predetermined distance above the support frame 12. The wire grid includes a border wire 26 vertically aligned with the perimeter of the support frame 12 and defining the boundary of the wire grid 14. A plurality of cross wires are supported in a criss-cross pattern on the border wire forming the wire grid. The cross wires include longitudinal wires 28 extending lengthwise of the border wire from end to end and lateral wires 30, normal to the longitudinal wires, extending side to side. The ends of the cross wires may be secured to the border wire 26 by various means including wrap around portions 32 as shown. At the junctures or crossing points 34 of the longitudinal and lateral wires, the two are secured together by welding or other conventionally known means. When this is done, the criss-cross network of the wire grid 14 is commonly referred to as a welded wire grid.

The wire grid is supported above the support frame at a predetermined distance by a plurality of wire form members 16. The wire form members are single pieces of formed wire extending lengthwise between the two ends of the foundation. If desired, the wire form members could be oriented to extend laterally between the two sides of the foundation. Each wire form member includes an elongated main body 36 which is positioned adjacent to one of the grid crosswires and is attached thereto by clips 38. At regularly spaced intervals along the main body of the wire form members, the wire form members include intermediate leg portions 40 comprising a pair of legs 42 extending from the main body 36. The legs 42 in each intermediate leg portion terminate in an intermediate foot 44 which is of a relatively short length generally parallel to the main body 36. The two legs 42 of each intermediate leg portion are inclined toward one another such that the intermediate leg portions 40 taper from the main body 36 to the feet 44.

The wire form members 16 terminate at their ends in end legs 46 which extend from the main body 36 and terminate in end feet 48 which are parallel to the main body 36 and are turned back toward the interior of the foundation 10. The end feet 48 and intermediate feet 44 are attached to the support frame 12 by staples 50 or other conventional fasteners. All of the legs of each support member lie substantially in a common plane.

Figure 4:
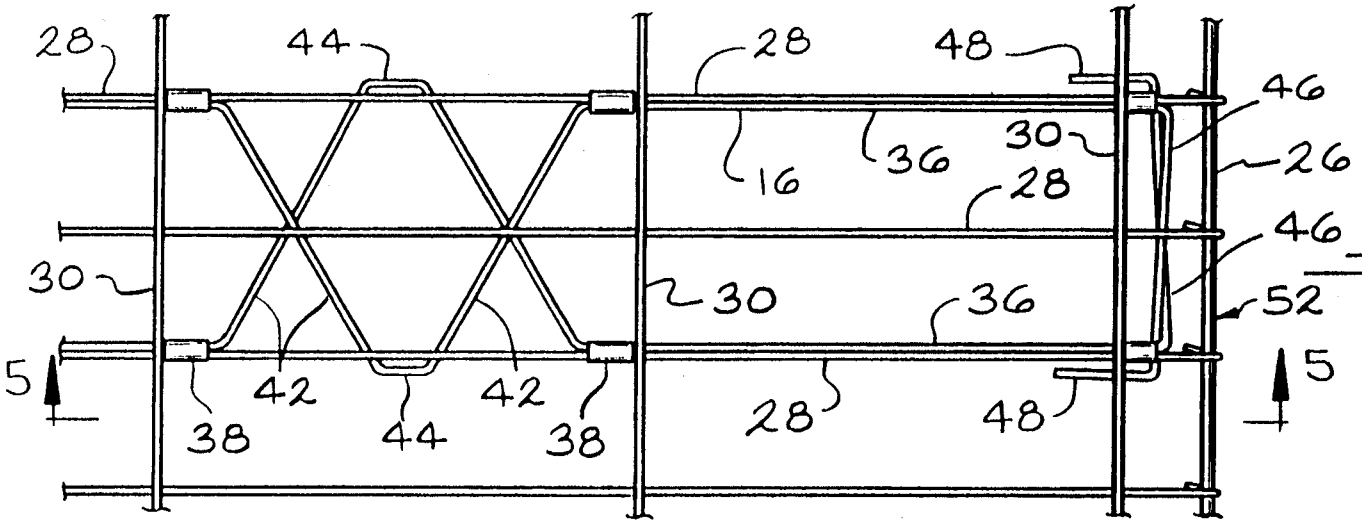
FIG. 4 is a top plan view of the foundation shown with the support members in a folded position.
Figure 5:
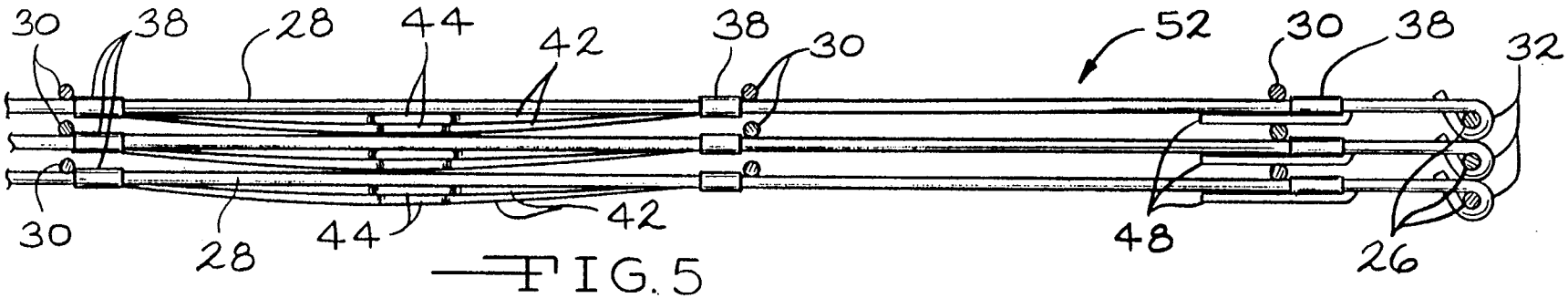
FIG. 5 is a side view of a plurality of the foundation wire subassemblies shown stacked one upon another.

The wire subassembly 52 consisting of the wire grid 14 and the wire form members 16 can be assembled at one Location and conveniently shipped to a second location for final assembly into the furniture foundation. If the foundation is shipped as shown in FIG. 1 with the grid attached to and raised from the support frame 12, the foundation assembly would occupy a large volume of space, increasing the shipping cost. Instead, wire subassemblies 52 consisting of the grid and the wire form members are shipped separate from the support frames 12. The wire form members are attached to the grid by the clips 38 in a manner that enables rotation of the wire form members about the longitudinal axis of their main bodies 36. This enables the wire form members to be rotated to a folded position shown in FIGS. 4 and 5 in which the legs are positioned against the grid and are nearly to parallel therewith. Doing so enables a plurality of the wire subassemblies 52 to be stacked one upon another in a compact stack shown in FIG. 5, occupying significantly less space than the same number of foundations fully assembled as shown in FIG. 1.

At final assembly, when the wire subassembly 52 is joined to the support frame 12, the wire form members 16 are rotated from their folded positions to standing positions in which the leg portions extend away from the grid. The leg portions, instead of extending normal to the grid, are inclined to the grid at an angle of less than ninety degrees. The wire form members are arranged in pairs with the leg portions of one wire form member in the pair being inclined in one direction and the leg portions of the other wire form member being inclined in the opposite direction. The two wire form members of a pair act together, when attached to the support frame 12, to resist collapse of the foundation by preventing rotation of the wire form members relative to the wire grid.

As shown in FIG. 1, the feet 44 and 48 of the paired wire form members are positioned adjacent to one another. The legs of the two wire form members form a substantially V-shaped leg structure when viewed from an end of the foundation assembly. The intermediate legs which taper toward one another in a downward direction also form a V-shaped configuration when viewed from the side of the foundation assembly. The intermediate leg portions of the paired wire form members cooperate together to form an inverted pyramid shape support structure 54 between the wire grid and the support frame. When the foundation is assembled, these pyramid support structures will resist horizontal shifting of the wire grid relative to the support frame in both the longitudinal and lateral directions.

The foundation of the present invention provides a firm support for a mattress at a relatively low cost using a minimal amount of wire. The configuration of the wire form members forming V-shaped leg structures eliminates the need to install inclined struts as shown in the prior art. In addition, the wire form members eliminate the need for support members oriented in different directions to prevent folding or collapse of the grid. This results in all of the wire form members being of identical shape and orientation whereby they can be conveniently mounted for rotation along parallel axes.

This facilitates assembly and shipment of the wire subassemblies 52 in compact stacks.

The wire form members are shown and described as being one piece members extending from end to end or side to side of the foundation. This facilitates assembly by providing one wire form member including several leg portions. However, the wire form members could be made shorter and to include as few as one leg portion.

It is to be understood that the invention is not limited to the exact construction illustrated and described above, but that various changes and modifications may be made without departing from the spirit and scope of the invention as defined in the following claims.

We claim:

1. A bedding foundation comprising:

a generally rectangular support frame;

a generally rectangular wire grid disposed above said support frame a predetermined distance; and a plurality of wire form members hingedly mounted on said wire grid for rotational movement between folded and standing positions, each of said wire form members having leg portions which, when said wire form members are in said folded position are disposed against said wire grid and which, when said wire form members are in said standing position extend from said wire grid at an angle of less than ninety degrees to the plane formed by said wire grid, said wire form members being arranged in pairs on said wire grid with the leg portions of one wire form member of each pair being inclined in the opposite direction relative to the leg portions of the other wire form member of said pair in said standing positions of said wire form members, said leg portions ending in feet at the distal ends thereof attached to said support frame to thereby enable said wire grid to be mounted on a support frame and maintained at said predetermined distance therefrom;

the hinged mounting of said wire form members permitting a plurality of subassemblies of said wire grids and said wire form members to stacked one upon another in a compact form with the wire form members in the folded positions.

2. The wire assembly of claim 1 wherein:

said wire grid includes a rectangular border wire having opposite longitudinal end edges and opposite lateral side edges and a plurality of cross wires supported in a criss-cross pattern on said border wire extending in one direction between said end edges and extending in another direction between said side edges; and said wire form members each being made of a single piece of formed wire having an elongated main body and which extend either from end to end or side to side of said wire grid, the main bodies of said wire form members being interrupted by said leg portions spaced along said main bodies.

3. The wire assembly of claim 1 wherein:

said wire form members are each made of a single piece of formed wire having a main body interrupted by spaced intermediate leg portions, said intermediate leg portions each having a pair of intermediate legs extending from said main body, said intermediate legs being joined at distal ends thereof by an intermediate foot parallel to said main body.

4. The wire assembly of claim 3 wherein the intermediate leg portions of one wire form member of a pair of wire form members are inclined toward the intermediate leg portions of the other wire form member of the pair and the feet of said paired wire form members are joined to one another and to said support frame in the standing position of said wire form members.

5. The wire assembly of claim 4 wherein the two intermediate legs of said intermediate leg portions are inclined toward one another so that the intermediate leg portions taper in a direction away from the main bodies of said wire form members and the intermediate leg portions of adjacent paired wire form members form an inverted four sided pyramid support structure between said wire grid and said support frame to resist end to end and side to side movement of said wire grid relative to said support frame.

6. The wire assembly of claim 3 wherein:

said wire grid includes a rectangular border wire having opposite longitudinal end edges and opposite lateral side edges and a plurality of cross wires supported in a criss-cross pattern on said border wire extending in one direction between said end edges and extending in another direction between said side edges; and the main bodies of said wire form members are mounted adjacent to cross wires of said wire grid and are attached thereto by a plurality of attaching clips permitting rotation of said wire form members about the longitudinal axes of their main bodies between said folded and said standing positions.

7. The wire assembly of claim 6 wherein:

the main body of each said wire form member terminating in end leg portions at the ends of each wire form member, each end leg portion having an end leg extending from said main body, and each said end leg terminating in an end foot, said end leg portions and said intermediate leg portions laying on a common plane.

8. The wire assembly of claim 6 wherein said wire form members rotate about parallel axes.

9. A wire subassembly for a bedding foundation comprising:

a generally rectangular wire grid including a rectangular border wire having opposite longitudinal end edges and opposite lateral side edges, said wire grid including a plurality of cross wires supported in a criss-cross pattern on said border wire extending in one direction between said end edges and extending in another direction between said side edges; and a plurality of wire form members hingedly mounted on said wire grid for rotational movement between folded and standing positions, each of said wire form members having leg portions which, when said wire form members are in said folded position are disposed against said wire grid and which, when said wire form members are in said standing position extend away from said wire grid at an angle of less than ninety degrees to the plane formed by said wire grid, said wire form members being arranged in pairs on said wire grid with the leg portions of one wire form member of each pair being inclined in the opposite direction relative to the leg portions of the other wire form member of said pair in the standing positions of said wire form members;

the hinged mounting of said wire form members to said wire grid permitting a plurality of said wire subassemblies to stacked one upon another in a compact form when the wire form members are in said folded positions.

10. The wire subassembly of claim 9 wherein said wire form members are each made of a single piece of formed wire having an elongated main body which extends either from end to end or side to side of said wire grid, the main bodies of said wire form members being interrupted by said leg portions spaced along said main bodies.

11. The wire subassembly of claim 10 wherein the main body of each said wire form member terminates in end leg portions at the ends of said wire form members, each end leg portion having an end leg extending from said main body, and each end leg terminating in an end foot; and said main body being interrupted between said end leg portions by intermediate leg portions each having a pair of intermediate legs extending from said main body, said pair of intermediate legs being joined at distal ends thereof by an intermediate foot parallel to said main body.

12. The wire assembly of claim 9 wherein at least one of the leg portions is an intermediate leg portion having a pair of intermediate legs extending from main bodies of said wire form members, said pair of intermediate legs being joined at distal ends thereof by an intermediate foot parallel to said main body;

the intermediate leg portions of one wire form member of a pair of wire form members being inclined toward the intermediate leg portions of the other wire form member of the pair of wire form members and the feet of said paired wire form members engaging one another in the standing position of said wire form members.

13. The wire assembly of claim 12 wherein the two intermediate legs of said intermediate leg portions are inclined toward one another so that the intermediate leg portions taper in a direction away from the main bodies of said wire form members and the intermediate leg portions of adjacent paired wire form members form a four legged pyramid support structure tapering away from said wire grid in the standing position of said wire form members.

14. The wire assembly of claim 13 wherein the main bodies of said wire form members are mounted adjacent to cross wires of said wire grid and are hingedly attached to permit rotation of said wire form members about the longitudinal axes of their main bodies between said folded and said standing positions.

15. A bedding foundation comprising:

a generally rectangular support frame;

a generally rectangular wire grid disposed above said support frame a predetermined distance, said wire grid including a rectangular border wire having opposite longitudinal end edges and opposite lateral side edges, said wire grid including a plurality of cross wires supported in a criss-cross pattern on said border wire extending in one direction between said end edges and extending in another direction between said side edges; and a plurality of wire form members mounted to said wire grid and said support frame to support said wire grid above said support frame, said wire form members including leg portions between said wire grid and said support frame, said leg portions including legs forming inverted four sided pyramids extending downwardly from said wire grid to said support frame.

16. The bedding foundation 15 wherein;

each leg portion includes two legs which are inclined toward one another in a direction extending from said wire grid; and said wire form members are arranged in pairs with the leg portions of pairs of said wire form members being inclined toward one another whereby the leg portions of the two paired wire form members form said inverted four sided pyramids extending downwardly from said wire grid to said support frame.

17. The bedding foundation 16 wherein said wire form members are each made of a single piece of formed wire having an elongated main body which extends either from end to end or side to side of said wire grid, the main bodies of said wire form members being interrupted by said leg portions spaced along said main bodies.

* * * * *